US009810107B2

(12) United States Patent
Oh et al.

(10) Patent No.: US 9,810,107 B2
(45) Date of Patent: Nov. 7, 2017

(54) INTERMEDIATE PHASE ADJUSTMENT APPARATUS OF CVVT

(71) Applicants: HYUNDAI MOTOR COMPANY, Seoul (KR); KIA MOTORS CORPORATION, Seoul (KR)

(72) Inventors: Chung Han Oh, Seongnam-si (KR); Yun Seok Kim, Yongin-si (KR); Jong Kuk Park, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 32 days.

(21) Appl. No.: 14/960,079

(22) Filed: Dec. 4, 2015

(65) Prior Publication Data

US 2017/0022853 A1 Jan. 26, 2017

(30) Foreign Application Priority Data

Jul. 24, 2015 (KR) ..... 10-2015-0105162

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2001/34426* (2013.01)

(58) Field of Classification Search
CPC ..... F01L 1/3442; F01L 2001/34426; F01L 2001/34423
USPC ..... 123/90.15, 90.17
See application file for complete search history.

(56) References Cited

U.S. PATENT DOCUMENTS 7,444,964 B2 * 11/2008 Kanada ..... F01L 1/34 123/90.15

FOREIGN PATENT DOCUMENTS

| | | | |
|---|---|---|---|
| JP | 2003-328707 | A | 11/2003 |
| JP | 2007-315373 | A | 12/2007 |
| JP | 2012-097630 | A | 5/2012 |
| KR | 2001-0030066 | A | 4/2001 |
| KR | 10-2004-0050307 | A | 6/2004 |
| KR | 10-2005-0010740 | A | 1/2005 |
| KR | 10-2009-0051577 | A | 5/2009 |

OTHER PUBLICATIONS

Notice of Allowance dated Mar. 11, 2016, issued in corresponding Korean patent application No. 10-2015-0105162.

* cited by examiner

*Primary Examiner* — Ching Chang
(74) *Attorney, Agent, or Firm* — McDermott Will & Emery LLP

(57) ABSTRACT

An intermediate phase adjustment apparatus of a CVVT includes check valves provided to prevent backflow of oil when the oil moves from one chamber to another chamber in order to secure a parking position of a lock pin in a CVVT of which an advance chamber and a retard chamber are formed between a rotor and a stator, and an oil inlet portion formed at the stator to correspond to inlet portions of the check valves, wherein an oil inlet portion provided at one chamber is formed larger than an oil inlet portion provided at the other chamber by a predetermined size, and the open angles of the check valves for making oil to flow into a chamber are increased, thereby preventing an offset occurrence by a cam torque.

6 Claims, 6 Drawing Sheets

[FIG.1]
Related Art
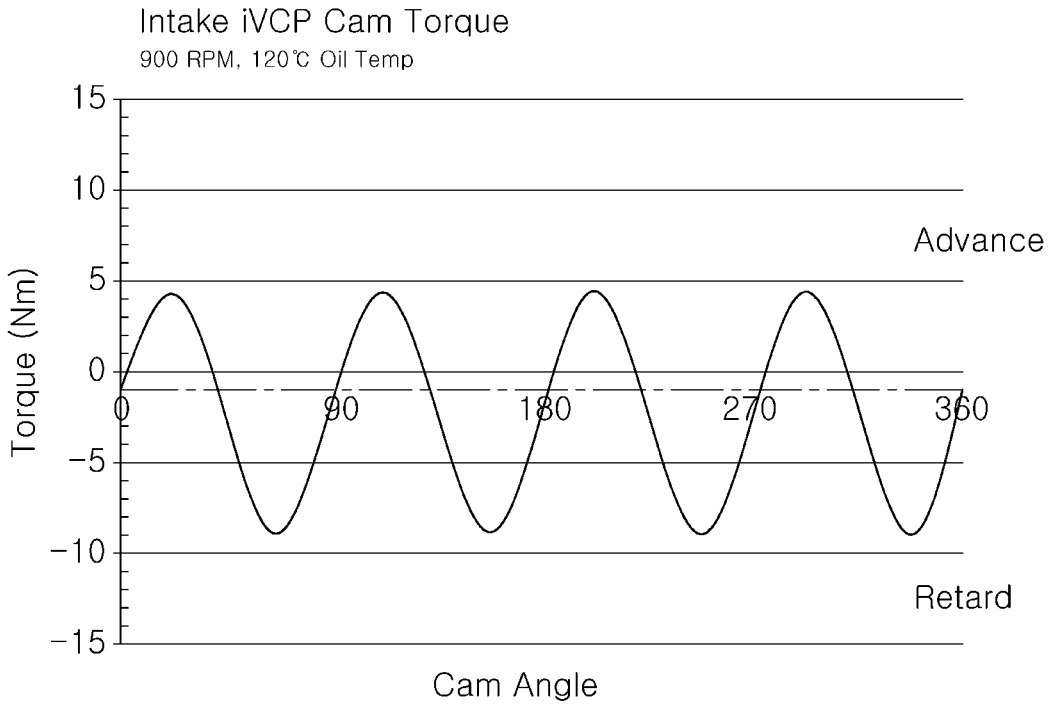
$T_{peak_retard} > T_{peak_advance}$

[FIG.2]
Related Art
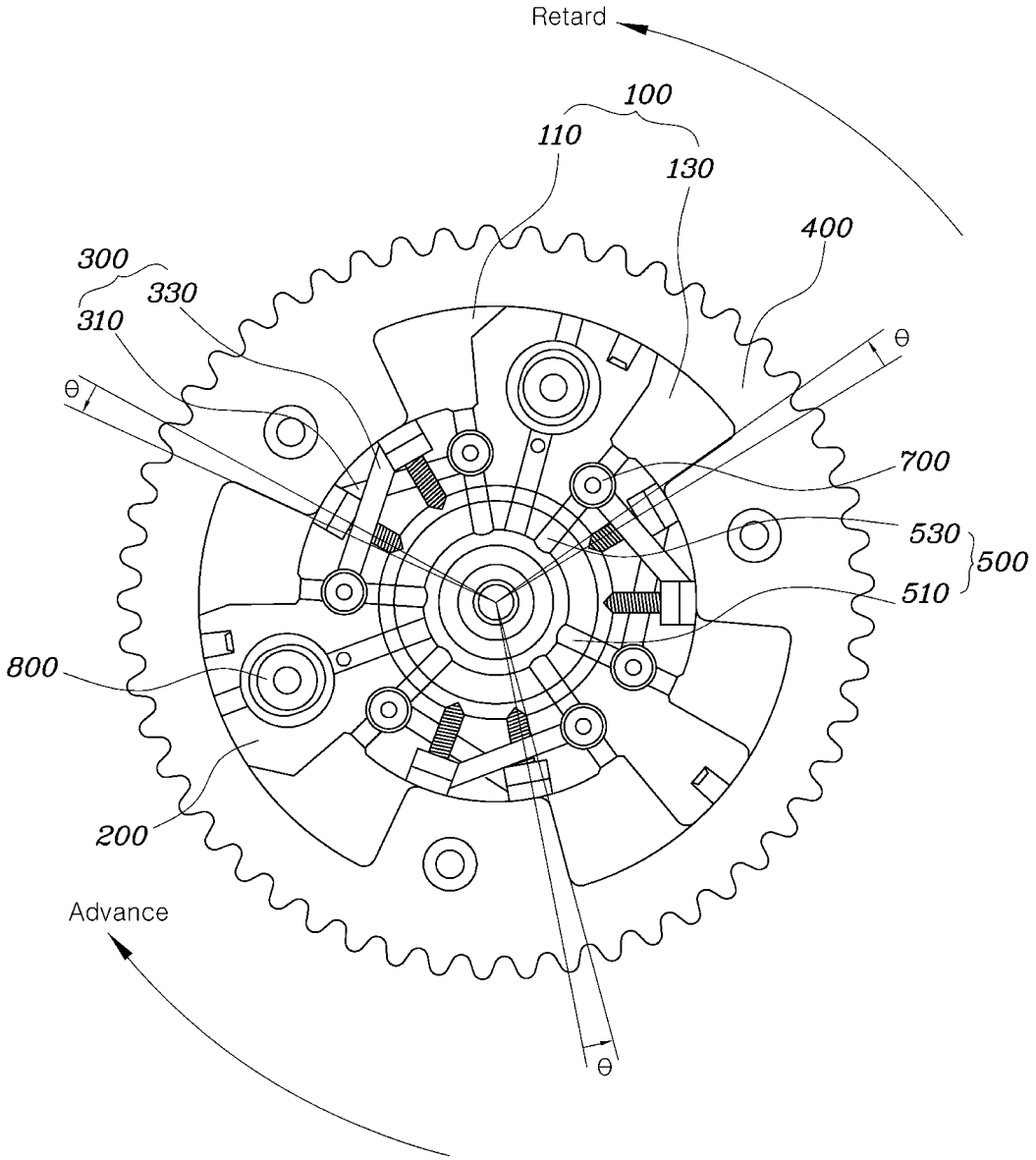

[FIG.3]
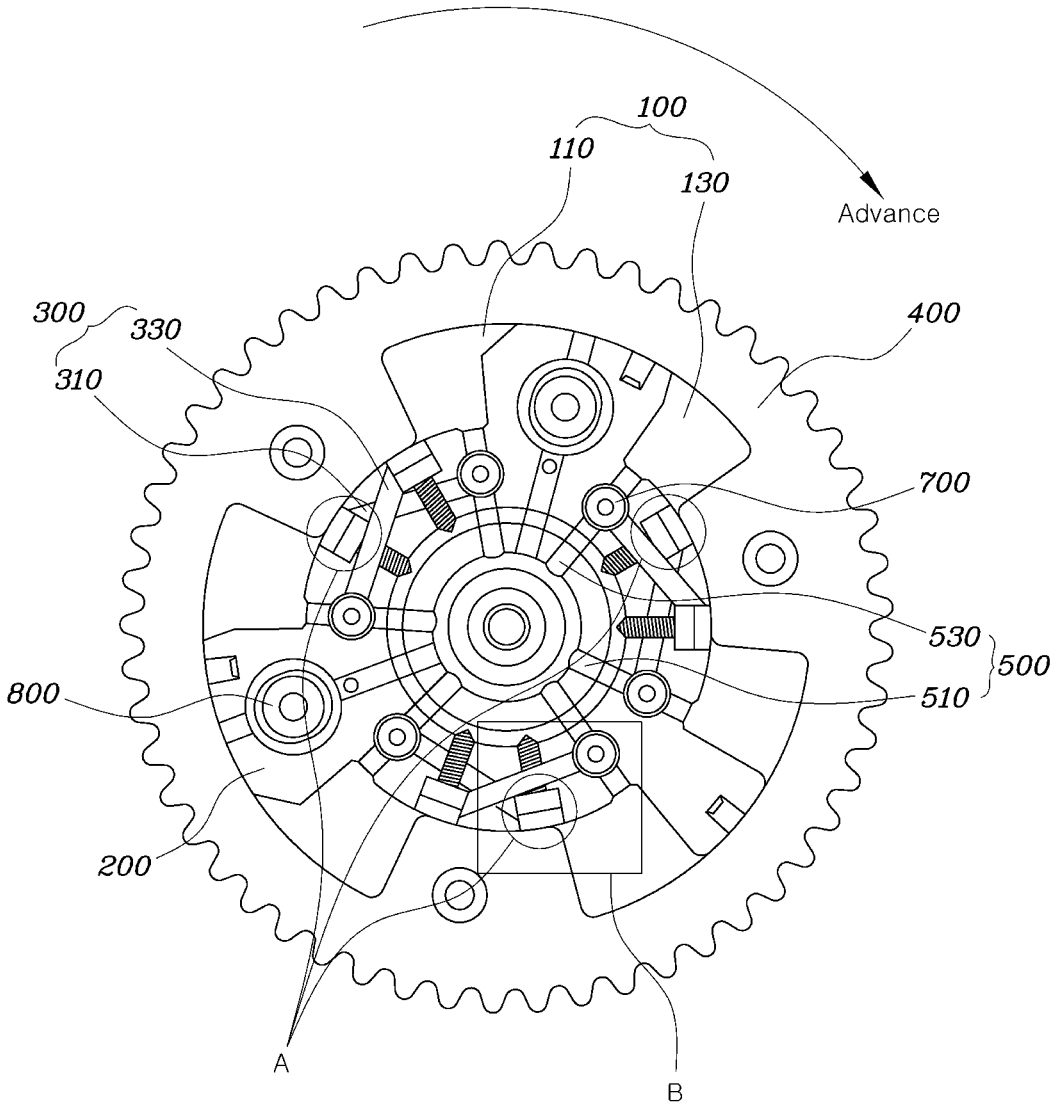

[FIG.4]
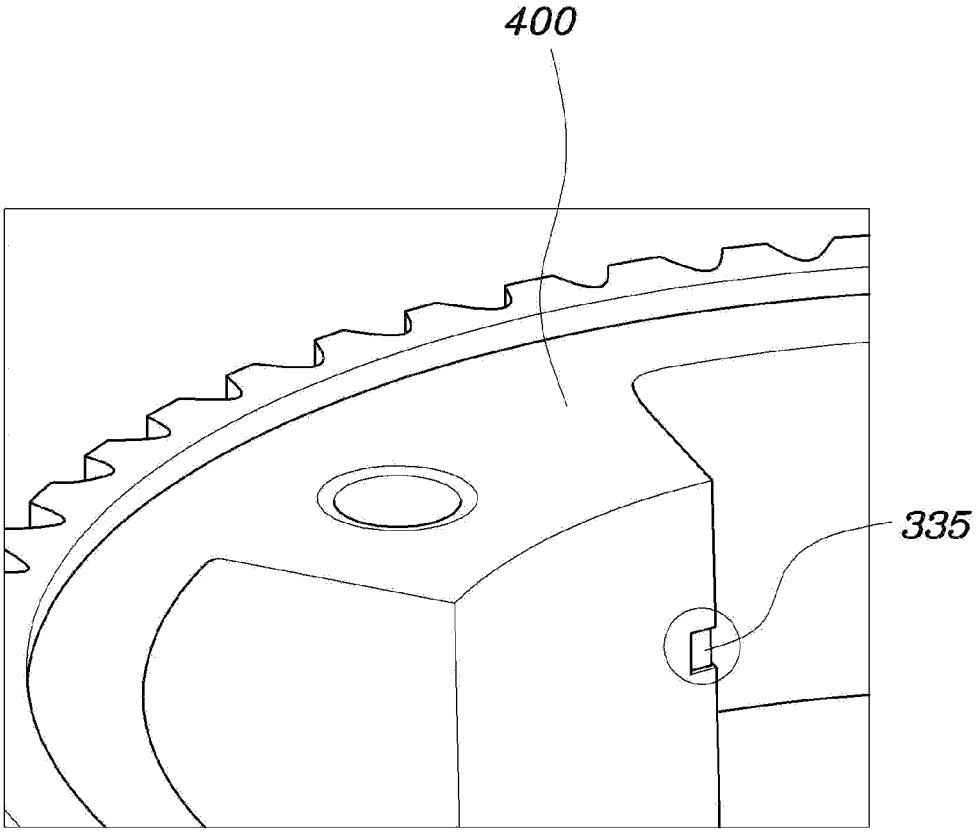

[FIG.5]
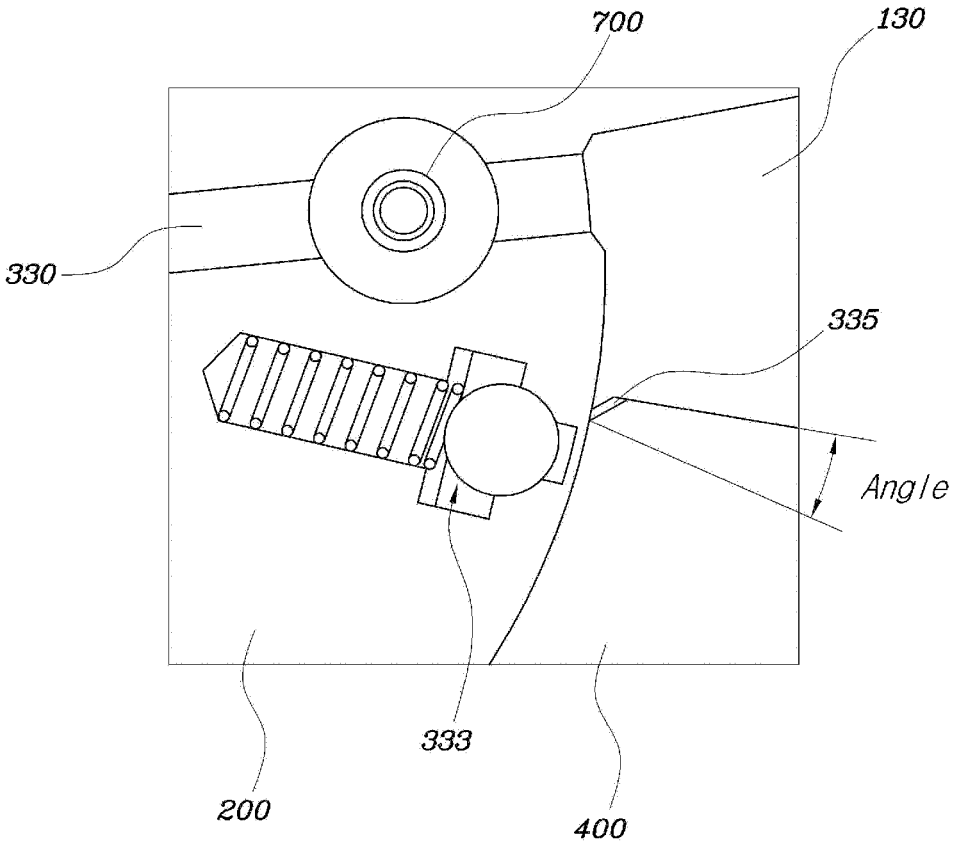

[FIG.6]
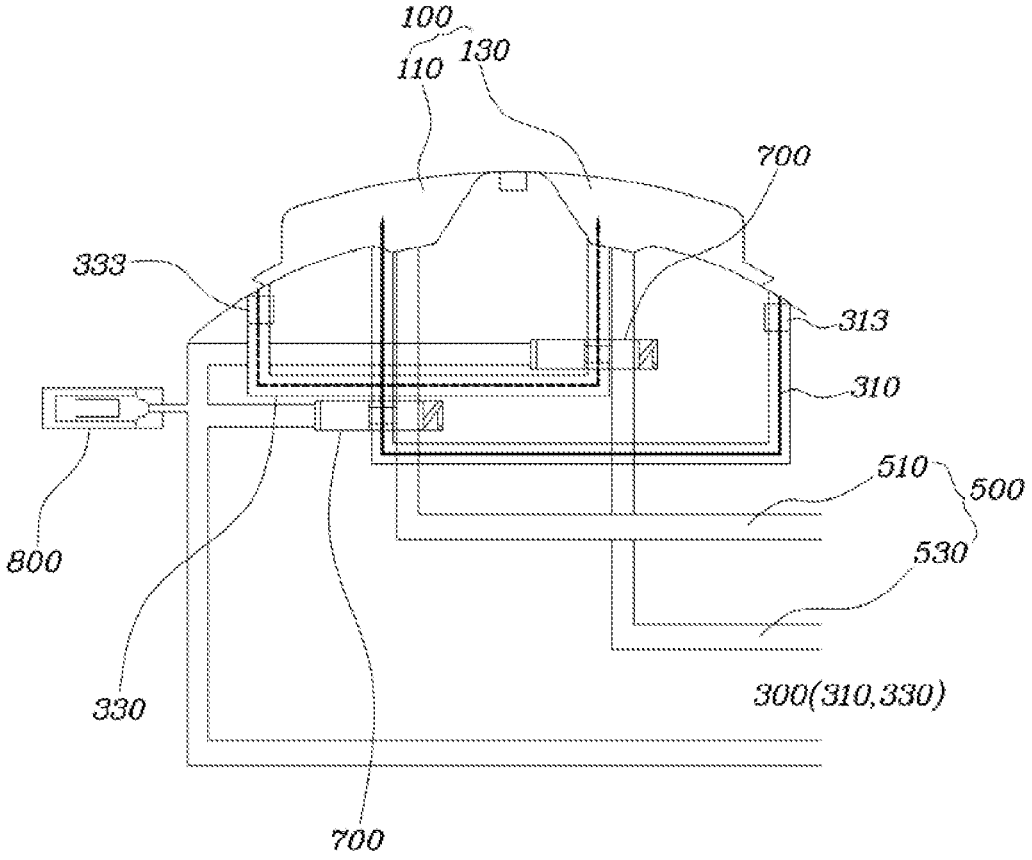

INTERMEDIATE PHASE ADJUSTMENT APPARATUS OF CVVT

CROSS REFERENCE TO RELATED APPLICATION

The present application claims the benefit of priority to Korean Patent Application No. 10-2015-0105162, filed Jul. 24, 2015 with the Korean Intellectual Property Office, the entire contents of which is incorporated herein for all purposes by this reference.

TECHNICAL FIELD

The present disclosure relates to an intermediate phase CVVT (Continuously Variable Valve Timing), and more particularly, to an intermediate phase adjustment apparatus of a CVVT allowing self-lock to be realized at all times by balancing oil pressures of an advance chamber and a retard chamber.

BACKGROUND

Generally, a CVVT (Continuously Variable Valve Timing) has been applied to a vehicle in order to reduce exhaust emissions and improve fuel efficiency and power output. Recently, the development of an intermediate phase CVVT system is being pursued by recognizing the limits to the responsibility and work area limitation of the conventional CVVT system and in order to improve it. Since this intermediate phase CVVT controls the cam position at an intermediate position, not the most advanced position (intake stroke) or most retarded position (exhaust stroke), the responsibility thereof is rapid and the use area of the cam can be widened, thereby improving fuel efficiency and reducing exhaust gases.

Meanwhile, in a case of a lock pin of the intermediate phase CVVT, the lock pin installed at a rotor side is locked into a lock pin hole formed at an intermediate position between an advance chamber and a retard chamber when the engine RPM (Revolutions Per Minute) is being reduced, thereby preparing for the subsequent engine start-up. At this time, the state where the lock pin is automatically locked into the lock pin hole during the engine RPM is reduced is a so-called "self-lock" state.

The self-lock is the function that allows the CVVT to return to an exact position mechanically without further adjustment in order to maintain driving safety of the engine at an area other than the operation area of the CVVT, that is, an idle driving state or a start-up of a vehicle.

However, when the CVVT is self-locked, it is possible to secure the intermediate position in the related art by balancing oil pressures of the advance chamber and the retard chamber. However, as shown in FIGS. 1 and 2, the oil pressure balance of the advance chamber and the retard chamber is broken by the average cam torque occurred. Specifically, since the average cam torque is strongly directed always toward the retard direction, a problem exists that the intermediate phase cannot be secured and an offset Θ occurred.

The foregoing is intended merely to aid in the understanding of the background of the present disclosure, and is not intended to mean that the present disclosure falls within the purview of the related art that is already known to those skilled in the art.

SUMMARY OF THE DISCLOSURE

Accordingly, the present disclosure has been made keeping in mind the above problems occurring in the related art, and the present disclosure is intended to propose an intermediate phase adjustment apparatus of a CVVT capable of removing the problem that an offset occurs without an intermediate phase secured by preventing the phenomenon that oil pressure balance between an advance chamber and a retard chamber is broken by an average cam torque when securing the intermediate phase of a CVVT.

According to one aspect, there is provided an intermediate phase adjustment apparatus of a CVVT including: check valves provided to prevent backflow of oil when the oil moves from one chamber to the other chamber in order to secure a parking position of a lock pin in a CVVT of which an advance chamber and a retard chamber are formed between a rotor and a stator; and an oil inlet portion formed at the stator to correspond to inlet portions of the check valves; wherein the oil inlet portion provided at one chamber is formed larger than the oil inlet portion provided at the other chamber by a predetermined size, the open angles of the check valves for making oil to flow into a chamber are increased, thereby preventing an offset occurrence by a cam torque.

The oil inlet portion may be formed at the retard chamber and the advance chamber, respectively, and the oil inlet portion of the retard chamber may be formed larger than the oil inlet portion of the advance chamber.

The open angle difference between the check valves by the size difference of the oil inlet portions may be 1~2°.

The oil inlet portion may be formed so that the size difference of the oil inlet portion is occurred by the depth difference indented in the radial direction of the stator.

The oil inlet portion may be formed so that the size difference of the oil inlet portion is occurred by the length difference indented in the fore and aft direction of the stator.

The oil inlet portion may be formed so that the size difference of the oil inlet portion is occurred by the depth difference indented in the radial direction and the length difference indented in the fore and aft direction of the stator.

According to the intermediate phase adjustment apparatus of a CVVT configured as described above, it is possible to realize more stable and robust structural CVVT in which an oil inlet portion of a check valve provided at a stator is formed largely at a retard chamber side than at an advance chamber side by considering cam torque effect so that the oil of the retard chamber can rapidly move to the advance chamber compared to the related art, thereby preventing offset phenomenon to balance oil pressure for an intermediate phase.

BRIEF DESCRIPTION OF THE DRAWINGS

The above and other objects, features and other advantages of the present disclosure will be more clearly understood from the following detailed description when taken in conjunction with the accompanying drawings, in which:

FIG. 1 is a graph showing an average cam torque;

FIG. 2 is a diagram representing the offset generated when securing an intermediate phase;

FIG. 3 is a diagram showing an intermediate phase adjustment apparatus of a CVVT according to an exemplary embodiment of the present disclosure;

FIG. 4 is a diagram showing a stator side of "A" portion in FIG. 3;

FIG. 5 is a detailed diagram of "B" portion in FIG. 3; and

FIG. 6 is a diagram representing an operation of FIG. 3.

DETAILED DESCRIPTION

Hereinafter, an intermediate phase adjustment apparatus of a CVVT according to an exemplary embodiment of the present disclosure will be described with reference to the attached drawings.

FIG. 3 is a diagram showing an intermediate phase adjustment apparatus of a CVVT according to an exemplary embodiment of the present disclosure, FIG. 4 is a diagram showing a stator side 400 of "A" portion in FIG. 3, FIG. 5 is a detailed diagram of "B" portion in FIG. 3, and FIG. 6 is a diagram representing an operation of FIG. 3.

The intermediate phase adjustment apparatus of a CVVT according to an exemplary embodiment of the present disclosure may include check valves 313, 333 provided to prevent a backflow of oil when the oil moves from one chamber to the other chamber in order to secure a parking position of a lock pin 800 in a CVVT of which an advance chamber 110 and a retard chamber 130 are formed between a rotor 200 and a stator 400; and an oil inlet portion 335 formed at the stator 400 to correspond to inlet portions of the check valves 313, 333. Specifically, since the oil inlet portion 335 provided at one chamber is formed larger than an oil inlet portion provided at the other chamber by a predetermined size, the open angles of the check valves 313, 333 for making oil to flow into a chamber 100 are increased, whereby the oil moves easily to prevent an offset occurrence by a cam torque such that the oil pressure balance between chambers is achieved.

Specially, as shown in FIG. 1, an average cam torque always strongly applies to a retard direction in the present disclosure, such that the oil pressure unbalance between the advance chamber 110 and the retard chamber 130 does not occur. In order for the check valve 333 of the retard chamber 130 to be opened earlier and closed later than the check valve 313 of the advance chamber 110 in the present disclosure, the oil inlet portion 335 is formed largely at the retard chamber side than the advance chamber side. Therefore, the open angle of the check valve 333 of the retard chamber 130 becomes larger than the open angle of the check valve 313 of the advance chamber 110 such that the oil in the retard chamber 130 can easily move to the advance chamber 110, thereby rapidly and exactly achieving the oil pressure balance between the advance chamber 110 and the retard chamber 130.

Furthermore, the open angle difference between the check valves 313, 333 by the size difference of the oil inlet portion 335 may be 1~2°, specifically 1.5°. The oil inlet portion 335 may be formed at the advance chamber 110 and the retard chamber 130, respectively. Therefore, when describing both the oil inlet portion 335 formed at the advance chamber 110 and the retard chamber 130, respectively, the reference number "335" of the oil inlet portion will be used. Furthermore, since only the oil inlet portion 335 of the retard chamber 130 is described and shown in FIG. 5 in this specification, the reference number "335" may be used when describing the oil inlet portion 335 of the retard chamber 130 in a narrow sense.

The oil inlet portion 335 may be formed so that the size difference of the oil inlet portion 335 can occur by the depth difference indented in the radial direction of the stator 400. Further, the oil inlet portion 335 may be formed so that the size difference of the oil inlet portion 335 can occur by the length difference indented in the fore and aft direction of the stator 400. Also, the oil inlet portion 335 may be formed so that the size difference of the oil inlet portion 335 can occur by the depth difference indented in the radial direction and the length difference indented in the fore and aft direction of the stator 400. That is, the oil inlet portion 335 of the retard chamber 130 is formed larger than the oil inlet portion of the advance chamber 110 as above described so that the check valve 333 of the retard chamber 130 is before opened and closed later than the check valve 313 of the advance chamber 110 to generate the open angle difference between the check valves 313, 333, whereby the oil of the retard chamber 130 can easily move toward the advance chamber 110 to balance the oil pressures of the retard chamber 130 and the advance chamber 110 rapidly and exactly.

Referring to FIG. 3 and FIG. 6, the operation forming the oil pressure balance between the chambers 100, among the operation of the intermediate phase adjustment apparatus of the CVVT according to the present disclosure, will be described.

FIG. 3 shows an oil passage 500, an oil line 300 allowing the oil to flow in one direction between the chambers 100, a switching valve 700 and a lock pin 800.

FIG. 6 shows the operation for securing an intermediate phase in order for the lock pin 800 to be locked for self-lock. For the self-lock, a retard oil line 330 in which the oil moves from the advance chamber 110 to the retard chamber 130 and an advance oil line 310 in which the oil moves from the retard chamber 130 to the advance chamber 110, are connected. At this time, an advance oil passage 510 and a retard oil passage 530 are closed by the switching valve 700. Therefore, the oil of the chamber 100 in which the relative high oil pressure is formed, moves toward the chamber 100 in which the relative low oil pressure is formed so that an oil pressure balance is formed to secure the intermediate phase.

At this time, the check valve 333, 313 provided at each oil line 300 prevents the backflow of the oil flowing from the relative high oil pressure chamber 100 to the original low oil pressure chamber 100 along the oil line 300 again. Specifically, the oil inlet portion 335 of the check valve 333 in the retard chamber 130 is formed larger than the oil inlet portion of the advance chamber 110 so that the open angle thereof is largely formed in order to be opened before and closed later than the check valve 313 of the advance chamber 110, thereby preventing the offset occurrence by the average cam torque.

According to the intermediate phase adjustment apparatus of a CVVT configured as described above, it is possible to realize a more stable and robust structural CVVT in which an oil inlet portion of a check valve provided at a stator is formed largely at a retard chamber side than at an advance chamber side by considering a cam torque effect so that the oil of the retard chamber can rapidly move to the advance chamber compared to the related art, thereby preventing an offset phenomenon to balance oil pressure for an intermediate phase.

Although a preferred embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. An intermediate phase adjustment apparatus of a CVVT of which an advance chamber and a retard chamber are formed between a rotor and a stator, comprising:

first and second check valves provided in the rotor to prevent backflow of oil when the oil moves from one chamber to another chamber in order to secure a parking position of a lock pin; and a first oil inlet portion provided in the advance chamber and a second oil inlet portion provided in the retard chamber, wherein each of the first and second oil inlet portions corresponds to each inlet of the first and second check valves, respectively;

wherein the second oil inlet portion provided at the retard chamber is larger than the first oil inlet portion provided at the advance chamber by a predetermined size, and an open angle of the second check valve for making oil to flow into the retard chamber is larger than an open angle of the first check valve for making the oil to flow into the advance chamber, thereby preventing an offset occurrence by a cam torque.

2. The intermediate phase adjustment apparatus of the CVVT of claim 1, wherein the second oil inlet portion of the retard chamber is larger than the first oil inlet portion of the advance chamber.

3. The intermediate phase adjustment apparatus of the CVVT of claim 1, wherein an open angle difference between the first and second check valves generated by a size difference between the first and second oil inlet portions is 1 ~2° .

4. The intermediate phase adjustment apparatus of the CVVT of claim 1, wherein the first and second oil inlet portions are formed such that a size difference of the first and second oil inlet portions occurs by a depth difference indented in a radial direction of the stator.

5. The intermediate phase adjustment apparatus of the CVVT of claim 1, wherein the first and second oil inlet portions are formed such that a size difference of the first and second oil inlet portions occurs by a length difference indented in a fore and aft direction of the stator.

6. The intermediate phase adjustment apparatus of the CVVT of claim 1, wherein the first and second oil inlet portions are formed such that a size difference of the first and second oil inlet portions occurs by a depth difference indented in a radial direction and a length difference indented in a fore and aft direction of the stator.

* * * * *